United States Patent [19]

Molaro

[11] 4,346,721

[45] Aug. 31, 1982

[54] HAIR BRUSH WITH HAIR CUTTING BLADE

[76] Inventor: Bernard Molaro, 232 Rue de Courcelles, 75017 Paris, France

[21] Appl. No.: 151,878

[22] Filed: May 21, 1980

[30] Foreign Application Priority Data

May 22, 1979 [FR] France ..... 79 13030

[51] Int. Cl.[3] ..... A45D 44/18

[52] U.S. Cl. ..... 132/85

[58] Field of Search ..... 132/85, 80, 45, 11 R; 30/30, 31, 34.2, 200, 41; 15/187

[56] References Cited

U.S. PATENT DOCUMENTS

| | | | |
|---|---|---|---|
| 1,892,836 | 1/1933 | Harvey | 132/80 |
| 2,331,370 | 10/1943 | Bowden | 132/80 R |
| 3,417,468 | 12/1968 | Miyauchi | 30/41 |
| 3,523,364 | 8/1970 | Crisanti | 30/30 |
| 3,536,080 | 10/1970 | Player | 132/45 R |
| 3,931,826 | 1/1976 | Moon | 132/85 |

*Primary Examiner*—G. E. McNeill

*Attorney, Agent, or Firm*—Schwartz, Jeffery, Schwaab, Mack, Blumenthal & Koch

[57] ABSTRACT

The invention concerns a hair brush comprising a rigid, essentially flat support body, from one face of which there are protruding perpendicularly threadlike parts of a semirigid material, constituting the bristles of the brush.

At least one opening is provided in the support body and a blade is secured to the support body so that the edge (or edges) of the blade extend into the opening (or openings) and is level with the surface of the support from which the bristles of the brush protrude.

The brush may represent a throwaway item that may be discarded after use, or it may have a replaceable blade and thus be reusable.

13 Claims, 7 Drawing Figures

HAIR BRUSH WITH HAIR CUTTING BLADE

BACKGROUND OF THE INVENTION

1. Field of the Invention

The invention concerns an improved hair brush also for the cutting of hair.

2. The Prior Art

In the art of hair dressing it has already been proposed to use combs equipped with a device to cut hair, generally consisting of a razor blade carried by the comb and arranged in a parallel manner with respect to the teeth of the comb.

By applying the comb, it is thus possible to cut hair, but the handling of such combs is a relatively delicate affair, because the comb and the blade are parallel to each other, which prevents the penetration of the blade into the mass of the hair and consequently, its action in depth, with the intent to perform what hair dressers call the thinning of the hair.

SUMMARY OF THE INVENTION

The present invention is intended to remedy this disadvantage by providing a new device for the cutting of hair, having a cutting element capable of superficially passing over the hair or penetrating into its mass to reduce its thickness.

For this purpose, the invention proposes a hair brush comprising a rigid support that is essentially flat, from the face of which a plurality of thread-like parts, made of a semirigid material and constituting the bristles of the brush, protrude generally perpendicularly, the brush having at least one opening provided in the support and a blade secured to the support so that the edge of the blade is generally level with that of the support from which the bristles of the brush protrude.

It is readily seen that in this manner it is sufficient to move the brush on or in the hair to effect a cutting action on it and that the bristles of the brush, by penetrating to a greater or lesser extent into the mass of the hair, will distribute the hair at the level of the blade, thus defining the volume of hair to be thinned out.

Advantageously, a double-edged razor blade is used as the blade of the device, with both edges of the razor blade being level with that surface of the brush from which the bristles protrude, so that a cutting action may be effected with the blade regardless of the direction in which the brush is moved.

The blade may be secured removably to the support of the brush, so that it may be periodically replaced.

The blade may also be secured permanently to the support of the brush, so that it forms, with the brush, a product that may be disposed of after use.

The length of the bristles of the brush is preferably different on the two sides of the edges of the blade and decreases, for example, in a continuous manner from one end of the brush to the other. Thus, when the brush is moved from the side where the bristles are the shortest, a simple cutting of the hair is performed, i.e., the hair is shortened, while during a reverse movement of the brush, when it is moved in the direction where the longest bristles penetrate deeply into the hair, the blade will effect an action of thinning the hair.

Two preferred forms of the invention are described herein below, as nonlimiting examples, with reference to the accompanying drawings.

THE PREFERRED EMBODIMENTS

Figure 1:
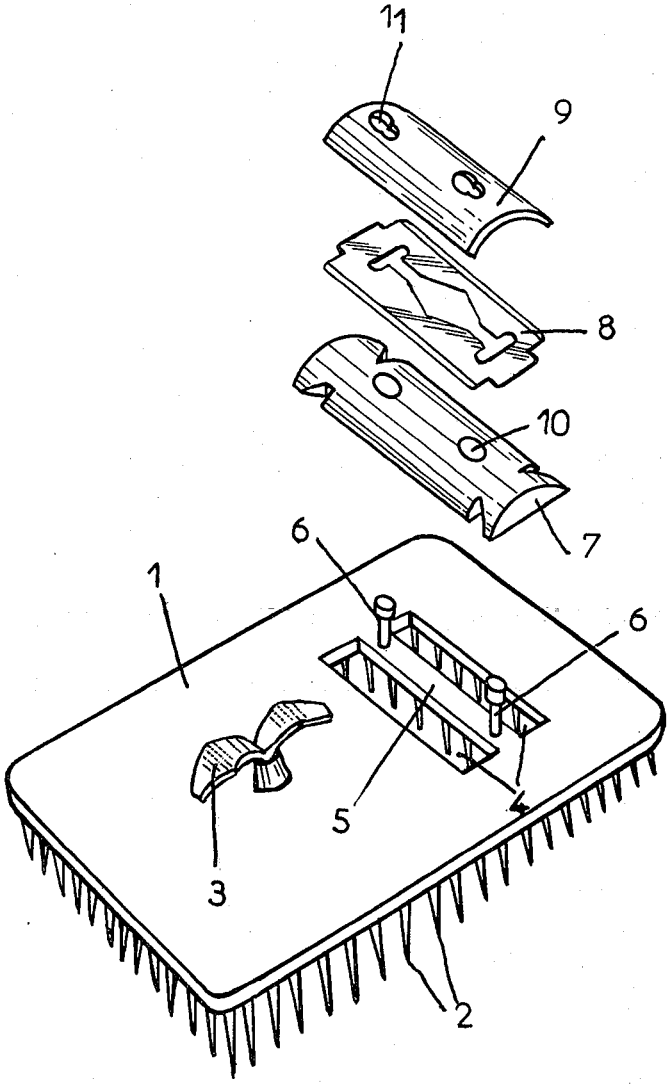
FIG. 1 shows an exploded perspective view of a first form, with a removable blade, of the brush according to the invention.
Figure 2:
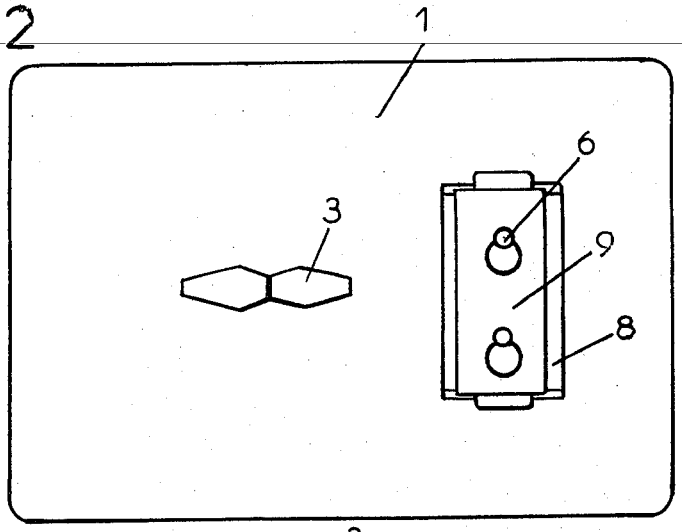
FIGS. 2, 3 and 4 shown, respectively, top, side and bottom views of the brush of FIG. 1.
Figure 3:
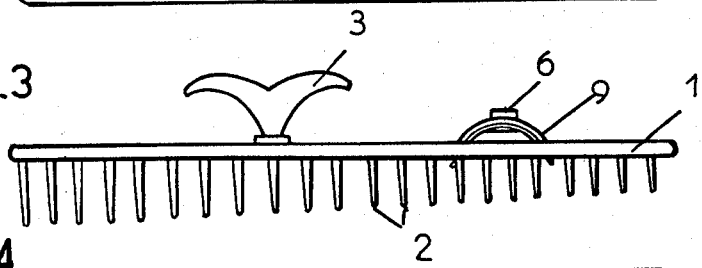
Figure 4:
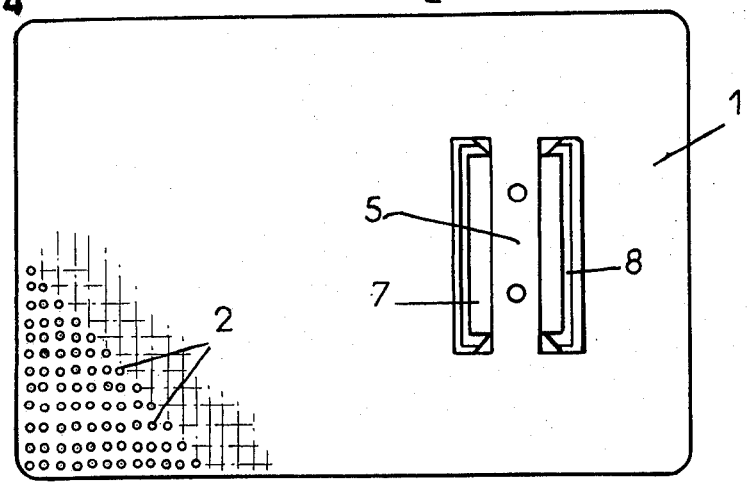
Figure 5:
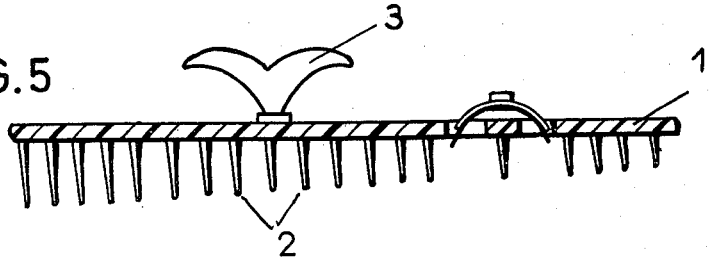
FIG. 5 shows a longitudinal cross-sectional view of the first form of the invention.

With reference initially to FIGS. 1 to 5, the brush comprises, in a known manner, a body 1 of a synthetic plastic material, serving as a flat support for semi-rigid bristles 2, also made of a synthetic plastic material, molded in one piece with the body 1 and protruding from its face, while the other face carries a handle 3.

According to the invention, the body 1 includes two parallel, rectangular openings 4 separated by a ridge 5 from which two locking pins with rounded heads protrude.

A rigid support member 7, in the form of a cylindrical section curved external upper surface, is provided for a razor blade 8, the blade 8 in turn being covered by a rigid retaining element 9 in the form of a curved, tile-like plate. The support 7 is perforated with orifices 10 so that it may be placed on the locking pins 6. In a similar manner, the retaining element 9 is provided with orifices 11 for allowing the passage of the locking pins 6 therethrough. More precisely, the orifices 11 are each defined by portions of two intersecting circles, one circle being of a diameter so that the head of a respective pin 6 can pass through, and the other circle being of a smaller diameter. To secure the blade 8 in position, it is thus merely necessary, by appropriately selecting the dimensions of the different elements, to engage the heads of the locking pins 6 in the larger diameter portion of the orifices 11, and then to slide the retaining element 9 in order to bring the smaller diameter portions of the orifices in a position under the heads of the locking pins 6, thus locking all of the elements in their operating position.

In this position, illustrated in FIGS. 2 to 5, the edges of the blade 8 extend into the openings 5 and with the face of body 1 which carries the bristles 2. It is thus sufficient to use the brush in the usual manner, by moving it in one direction or the other with the aid of the handle 3, to effect a cutting action on the hair.

As shown in the drawings, the bristles 2 may advantageously be of a length that decreases from one end to the other, so that the blade 8 will act in a different fashion depending on the direction of its motion: in the direction in which the bristles 2 are shorter, the brush will pass over the hair in an essentially uniform manner, without penetrating the mass of the hair; in contrast, in the direction in which the bristles are longer, the brush will penetrate the mass of the hair, thus insuring the thinning of it.

It should be noted that the bristles of the brush will distribute the hair at the level of the blade, under the effect of the movement of the brush by the user, and that the user may thus perfectly control the action of the blade and obtain the cut that is desired. For this purpose, the user's hair is preferably wetted prior to the use of the brush, so that the hair is moved uniformly and flexibly by the brush.

The present invention is not limited to the form of the brush described above with reference to FIGS. 1–5, and it will be recognized that numerous other variants may be conceived by those skilled in the art without exceeding the scope of the claims which follow below.

Figure 6:
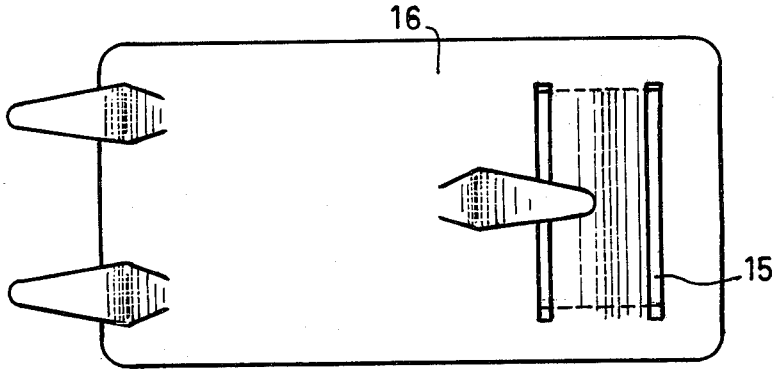
FIGS. 6 and 7 show, respectively, top and bottom plan views of a second form of the invention with a permanently attached blade.
Figure 7:
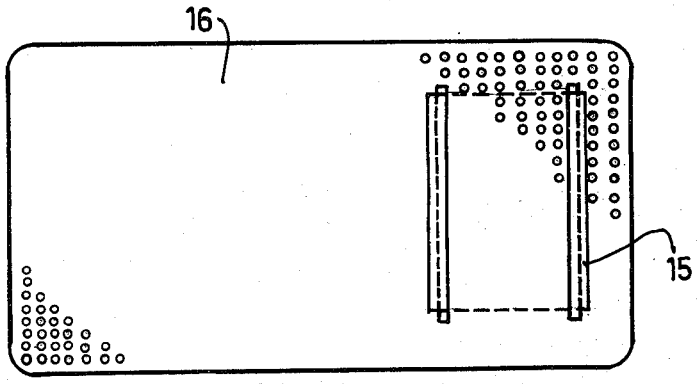

Thus, for example, in the form of the invention shown in FIGS. 6 and 7, the blade 15 cannot be removed from the body 16 of the brush. This body may be made by moulding a synthetic plastic material, and the blade 15 may be readily incorporated into the body in the course of the molding operation. In this form of the invention, the brush represents a throwaway item, comparable to certain types of razors, which may be discarded after use.

I claim:

1. A hair brush, comprising:

(a) an essentially flat, rigid support having two openings;

(b) a plurality of semi-rigid thread-like parts protruding generally perpendicularly from one face of the support and constituting bristles of the brush, and (c) a double edged blade, and means for securing the blade on the support, each cutting edge of the blade extending through a respective one of the openings and being generally level with said one face of the support from which the thread-like parts protrude.

2. The hair brush according to claim 1, wherein the blade is removably secured to the support.

3. The hair brush according to claim 1, wherein the blade is molded integrally with the support, whereby the blade is not removable from the support and the hair brush is disposable after use.

4. The hair brush according to claim 1, wherein the thread-like parts constituting bristles of the brush are longer in the vicinity of one cutting edge of the razor blade than in the vicinity of the other cutting edge of the razor blade.

5. The hair brush according to claim 4, wherein the length of the thread-like parts constituting bristles of the brush decreases uniformly from one end of the brush to the other.

6. The hair brush according to claim 2, wherein means for securing the blade on the support comprises a rigid blade support member on the support, the blade resting on the rigid blade support member.

7. The hair brush according to claim 6, further comprising a retaining element for the blade, and means for locking the retaining element to the support to thereby secure the blade to the support.

8. A hair brush, comprising:

(a) an essentially flat, rigid support having longitudinal ends;

(b) a plurality of semi-rigid thread-like parts protruding generally perpendicularly from one face of the support and constituting bristles of the brush;

(c) at least one generally rectangular opening formed in said support intermediate the longitudinal ends thereof and spaced substantially inwardly from one of said ends;

(d) blade means secured to said support and deformed in a downwardly concave manner such that a cutting edge of said blade means protrudes downwardly through said opening generally level with said one face of said support, and (e) means for supporting and retaining said blade means in said concave deformed position.

9. The hair brush according to claim 8, wherein said blade means is removably secured to the support.

10. The hair brush according to claim 8, wherein said blade means is molded integrally with the support, whereby the blade means is not removable from the support and the hair brush is disposable after use.

11. The hair brush according to claim 8, wherein the thread-like parts constituting bristles on the brush are longer in the vicinity of one cutting edge of the razor blade than in the vicinity of the other cutting edge of the razor blade, the length of said bristles decreasing uniformly from one end of the brush to the other.

12. The hair brush according to claim 8 wherein said means for supporting and retaining said blade means comprises a rigid blade support member on the support, said blade means resting on the rigid blade support member.

13. The hair brush according to claim 12, further comprising a retaining element for the blade means, and means for locking the retaining element to the support to thereby secure the blade means to the support.

* * * * *